US010886651B2

(12) United States Patent
Tsai

(10) Patent No.: US 10,886,651 B2
(45) Date of Patent: Jan. 5, 2021

(54) ELECTRICAL CONNECTOR ASSEMBLY AND ELECTRICAL CONNECTOR SYSTEM USING THE SAME

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Kuei-Chung Tsai, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/521,951

(22) Filed: Jul. 25, 2019

(65) Prior Publication Data

US 2020/0036124 A1 Jan. 30, 2020

(30) Foreign Application Priority Data

Jul. 27, 2018 (CN) ..... 2018 1 0839008

(51) Int. Cl.

| | |
|---|---|
| ***H01R 12/79*** | (2011.01) |
| ***H01R 12/71*** | (2011.01) |
| ***H01R 13/24*** | (2006.01) |
| ***H01R 13/46*** | (2006.01) |
| ***H01R 31/06*** | (2006.01) |

(52) U.S. Cl.

CPC ..... *H01R 12/79* (2013.01); *H01R 12/716* (2013.01); *H01R 13/2414* (2013.01); *H01R 13/46* (2013.01); *H01R 31/06* (2013.01)

(58) Field of Classification Search

CPC ..... H01R 12/79; H01R 31/06; H01R 13/46; H01R 13/2414; H01R 12/716; H01R 12/714; H01R 12/62; H01R 12/592

See application file for complete search history.

(56) References Cited

U.S. PATENT DOCUMENTS

| | | | | |
|---|---|---|---|---|
| 4,087,146 A * | 5/1978 | Hudson, Jr. | ..... | H01R 12/714 439/67 |
| 4,770,645 A * | 9/1988 | Antes | ..... | H01R 12/62 439/329 |
| 7,238,032 B2 * | 7/2007 | Pabst | ..... | H01R 13/635 439/67 |
| 9,011,177 B2 | 4/2015 | Lloyd | | |
| 9,077,125 B2 * | 7/2015 | Hogan | ..... | H01R 12/724 |

(Continued)

*Primary Examiner* — Truc T Nguyen

(74) *Attorney, Agent, or Firm* — Wei Te Chung; Ming Chieh Chang

(57) ABSTRACT

An electrical connector assembly used in an interior of an electronic device which includes an internal printed circuit board, a chip mounted on internal printed circuit board, internal conductive pads disposed close to the chip and electrically connected to the chip, and an interface connector away from the chip and electrically connected to the external electrical connector comprises a first connector electrically connected to the internal conductive pads and a cable connecting with the first connector, the cable being able to electrically connect to the interface connector, wherein the first connector includes first elastic terminals elastically contacting the internal conductive pads.

16 Claims, 12 Drawing Sheets

(56) References Cited

U.S. PATENT DOCUMENTS

| | | | | |
|---|---|---|---|---|
| 9,281,597 | B2 * | 3/2016 | Hashiguchi | H01R 12/774 |
| 10,581,189 | B2 * | 3/2020 | Qiao | H01R 12/79 |
| 2009/0208168 | A1 * | 8/2009 | Ishikawa | H01R 13/639 385/14 |
| 2010/0035462 | A1 * | 2/2010 | Lin | H01R 12/592 439/495 |
| 2010/0041273 | A1 * | 2/2010 | Scherer | H01R 13/6597 439/607.01 |
| 2010/0055984 | A1 * | 3/2010 | Tsuchida | H01R 12/716 439/626 |
| 2013/0178075 | A1 * | 7/2013 | Hsueh | H01R 12/721 439/62 |
| 2014/0148021 | A1 * | 5/2014 | Hsu | H01R 12/79 439/67 |
| 2015/0207244 | A1 * | 7/2015 | Urano | H01R 12/91 439/83 |
| 2015/0214644 | A1 * | 7/2015 | Chang | H01R 12/594 439/498 |
| 2015/0311614 | A1 * | 10/2015 | Kondo | H01R 13/035 439/733.1 |
| 2017/0125961 | A1 * | 5/2017 | Kim | H01R 43/0207 |
| 2019/0181570 | A1 * | 6/2019 | Ellis | H01R 43/205 |
| 2019/0267732 | A1 * | 8/2019 | Buck | H01R 12/85 |
| 2019/0288435 | A1 * | 9/2019 | Lee | H01R 13/41 |
| 2019/0288457 | A1 * | 9/2019 | Champion | H01R 12/598 |
| 2019/0348784 | A1 * | 11/2019 | Yufu | H01R 13/5025 |
| 2019/0348800 | A1 * | 11/2019 | Yufu | H01R 13/6593 |
| 2019/0386411 | A1 * | 12/2019 | Kikuchi | H01R 13/428 |

* cited by examiner

ELECTRICAL CONNECTOR ASSEMBLY AND ELECTRICAL CONNECTOR SYSTEM USING THE SAME

BACKGROUND OF THE INVENTION

1. Field of the Invention

The present invention relates generally to an electrical connector assembly and electrical connector system using the same, and more particularly to electrical connector assembly and electrical connector system with high speed signal connection structure.

2. Description of Related Arts

An electrical connector system is disclosed in U.S. Pat. No. 9,011,177, issued on Apr. 21, 2015. The electrical connector system includes a printed circuit board mounted in the device, a chip mounted on the printed circuit board, a peripheral connector mounted around the device and an internal cable connector assembly connecting the peripheral connector with the chip. The cable connector assembly is electrically connected to the printed circuit board by means of perforation or extrusion mounting. However, the perforation installation requires further soldering to achieve electrical connection, and the extrusion installation requires a large installation space and a strong structural strength, so that the volume is large.

An improved electrical connector assembly is desired.

SUMMARY OF THE INVENTION

An object of the present invention is to provide an electrical connector assembly that is simple in structure, easy to install, and small in size.

To achieve the above-mentioned object, an electrical connector assembly used in an interior of an electronic device which includes an internal printed circuit board, a chip mounted on internal printed circuit board, internal conductive pads disposed close to the chip and electrically connected to the chip, and an interface connector away from the chip and electrically connected to the external electrical connector comprises a first connector electrically connected to the internal conductive pads and a cable connecting with the first connector, the cable being able to electrically connect to the interface connector, wherein the first connector includes first elastic terminals elastically contacting the internal conductive pads.

Another object of the present invention is to provide an electrical connector system that is simple in structure, easy to install, and small in size. To achieve this object, an electrical connector system includes an internal printed circuit board inside an electronic device, a chip mounted on internal printed circuit board, internal conductive pads disposed close to the chip and electrically connected to the chip, an interface connector away from the chip and electrically connected to the external electrical connector, and an electrical connector assembly electrically connecting with the internal conductive pads and the interface connector, the electrical connector assembly including a first connector electrically connecting to the internal conductive pads and a cable connecting with the first connector, the cable being able to electrically connect to the interface connector, wherein the first connector includes first elastic terminals elastically contacting the internal conductive pads.

DETAILED DESCRIPTION OF THE PREFERRED EMBODIMENT

Figure 1:
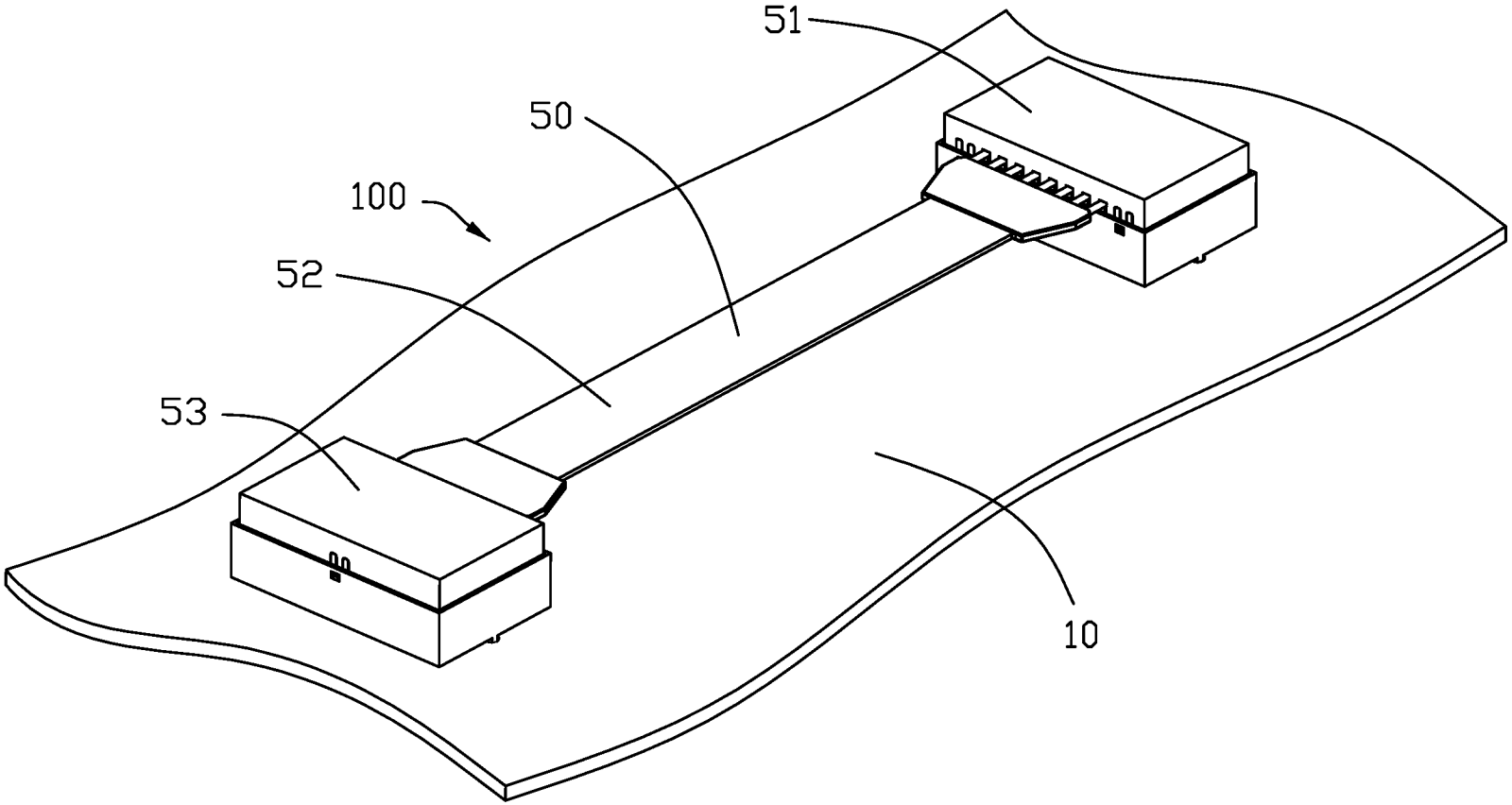
FIG. 1 is a perspective view of an electrical connector system in accordance with the present invention.
Figure 2:
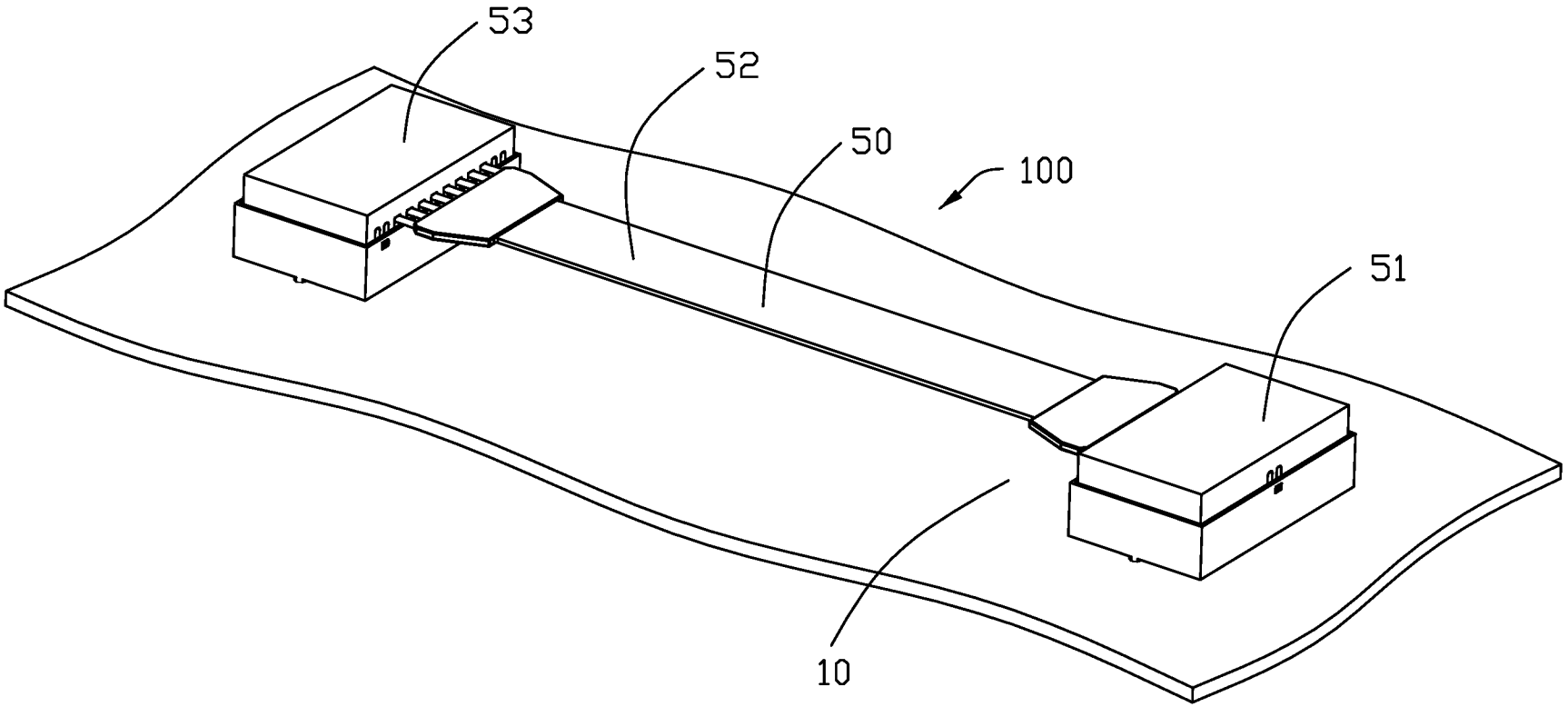
FIG. 2 is another perspective view of the electrical connector system as shown in FIG. 1.
Figure 3:
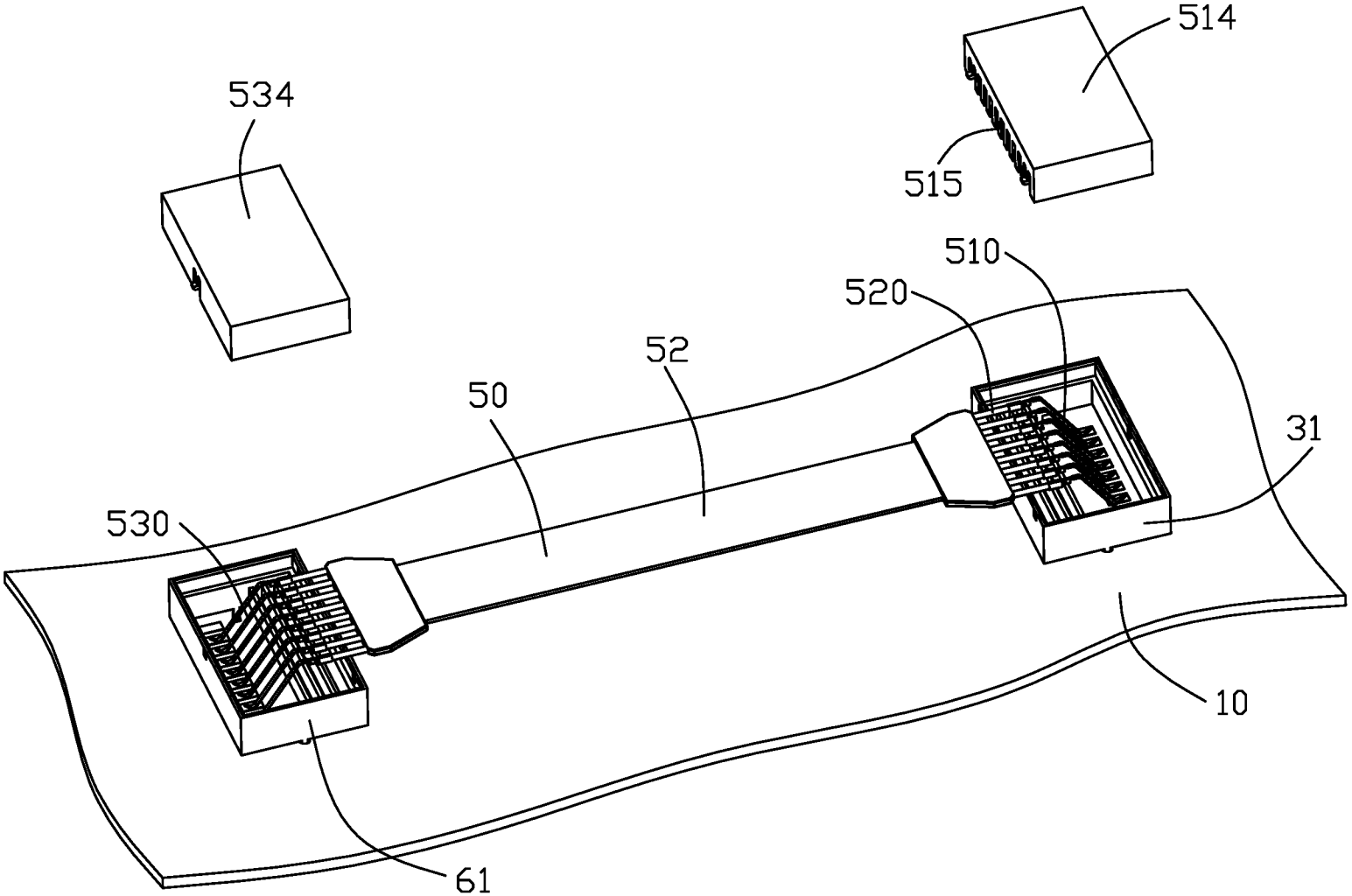
FIG. 3 is a partially exploded perspective view of the electrical connector system as shown in FIG. 1.
Figure 4:
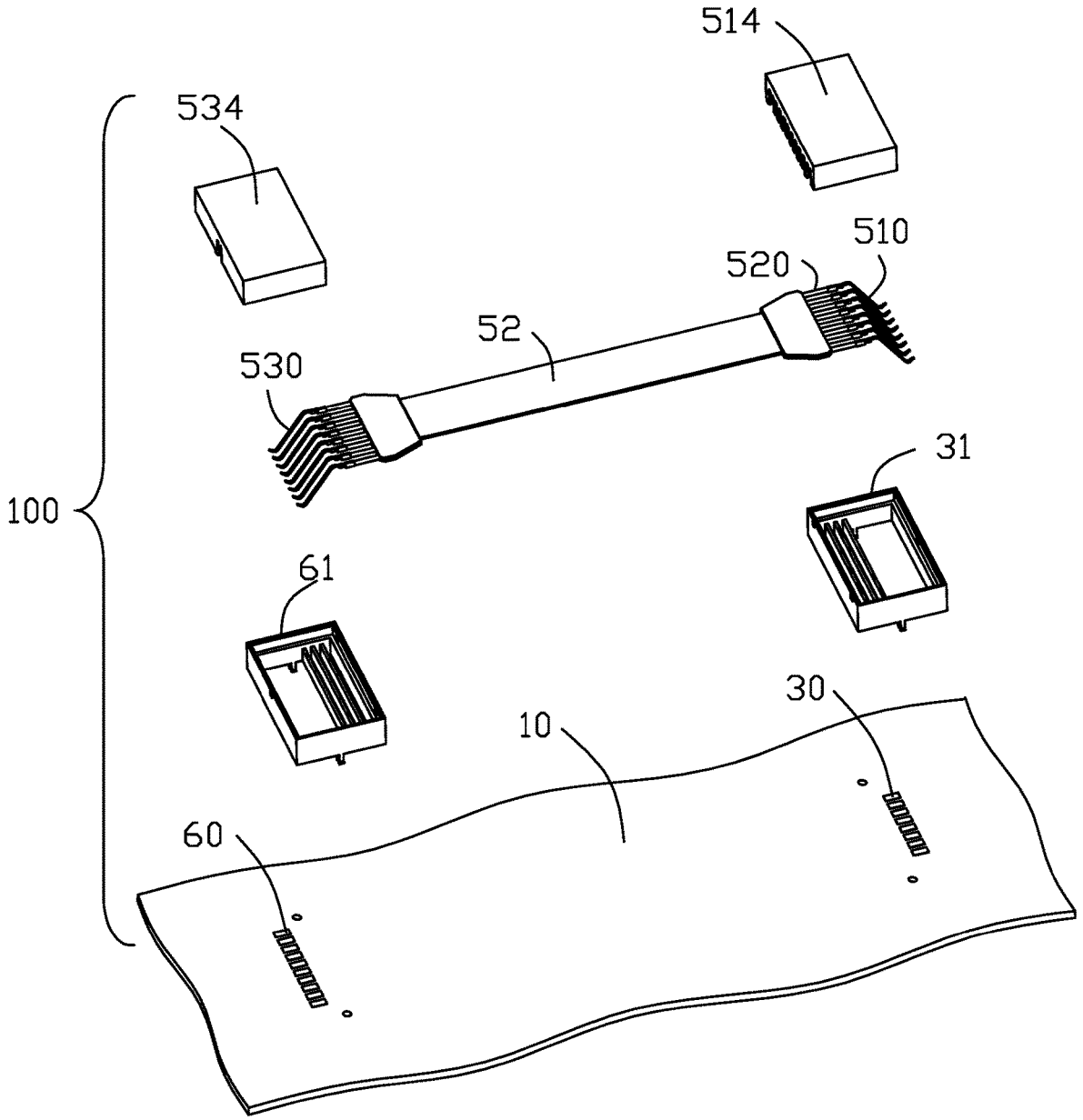
FIG. 4 is a further exploded view of the electrical connector system as shown in FIG. 3.
Figure 5:
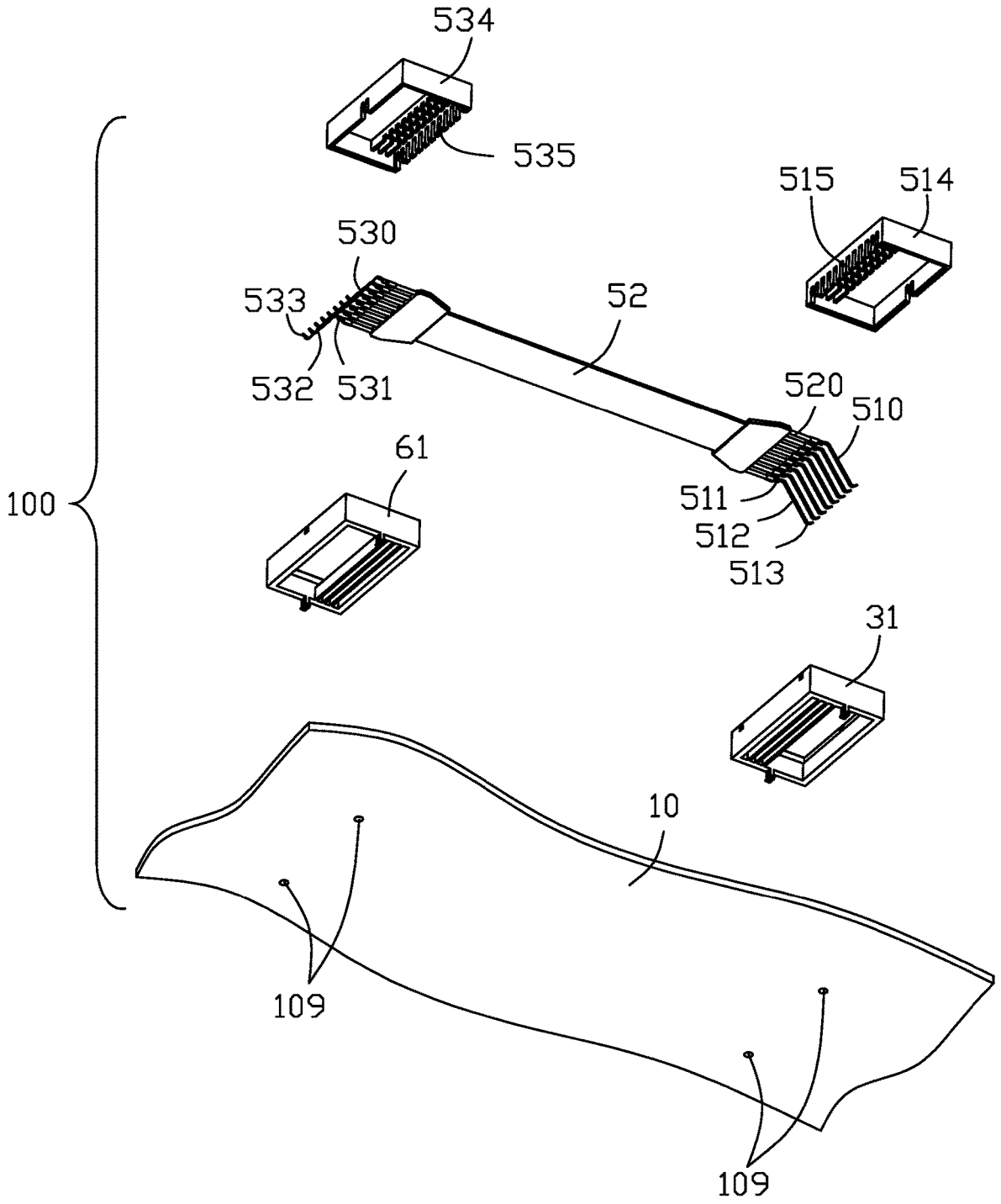
FIG. 5 is another further exploded view of the electrical connector system as shown in FIG. 4.
Figure 5A:
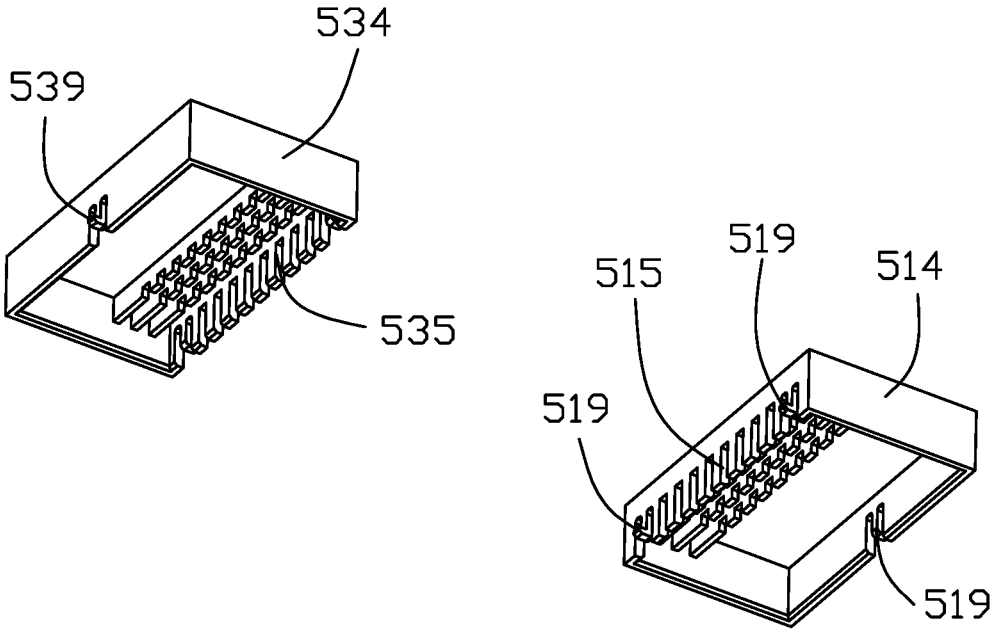
FIG. 5(A) is a perspective view of the holders.
Figure 5B:
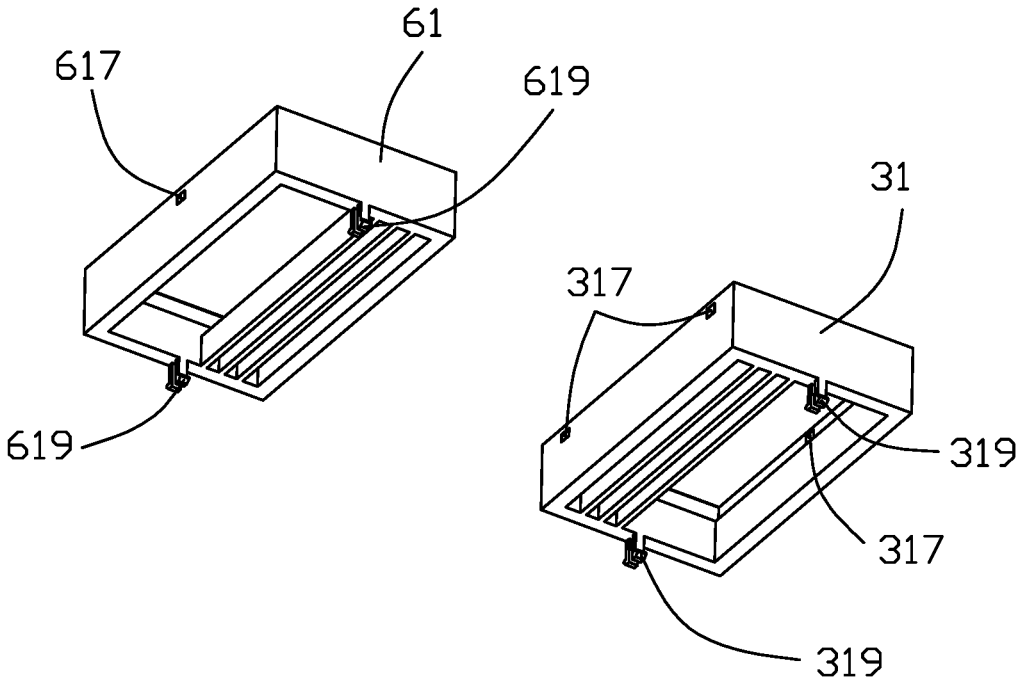
FIG. 5(B) is a perspective view of the frames.
Figure 6:
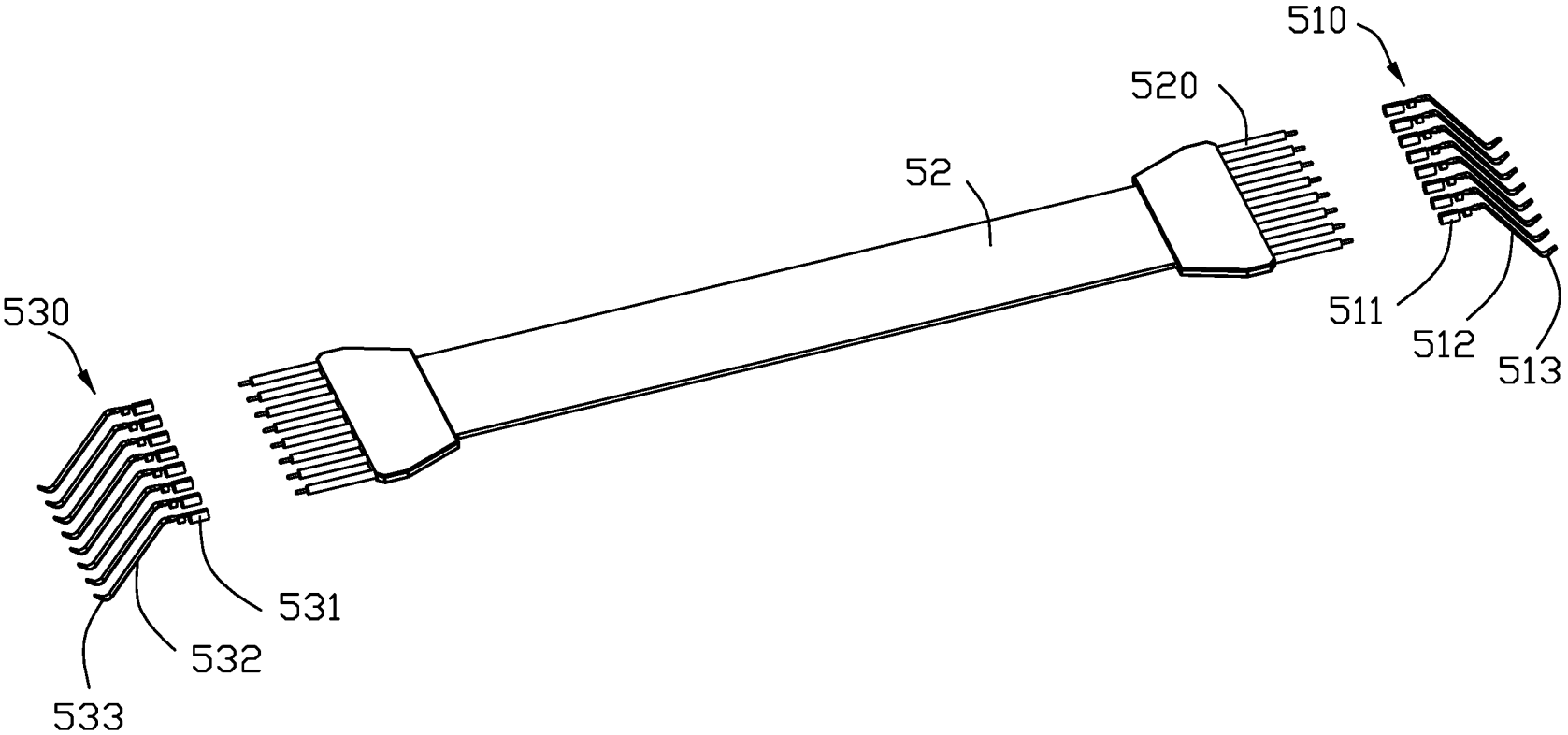
FIG. 6 is a partially exploded view of an electrical connector assembly of the electrical connector system as shown in FIG. 1.
Figure 7:
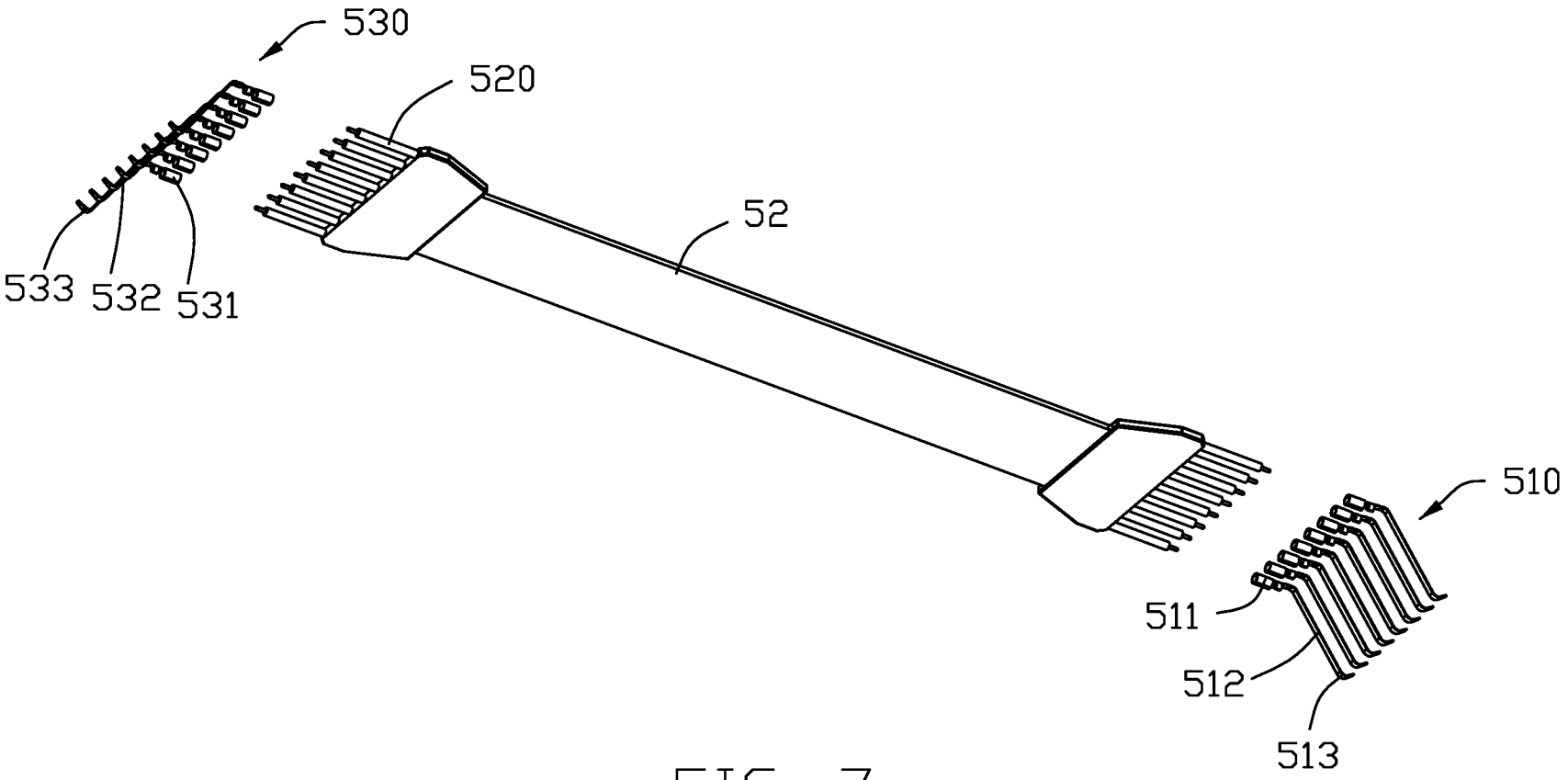
FIG. 7 is another partially exploded view of an electrical connector assembly as shown in FIG. 6.
Figure 8:
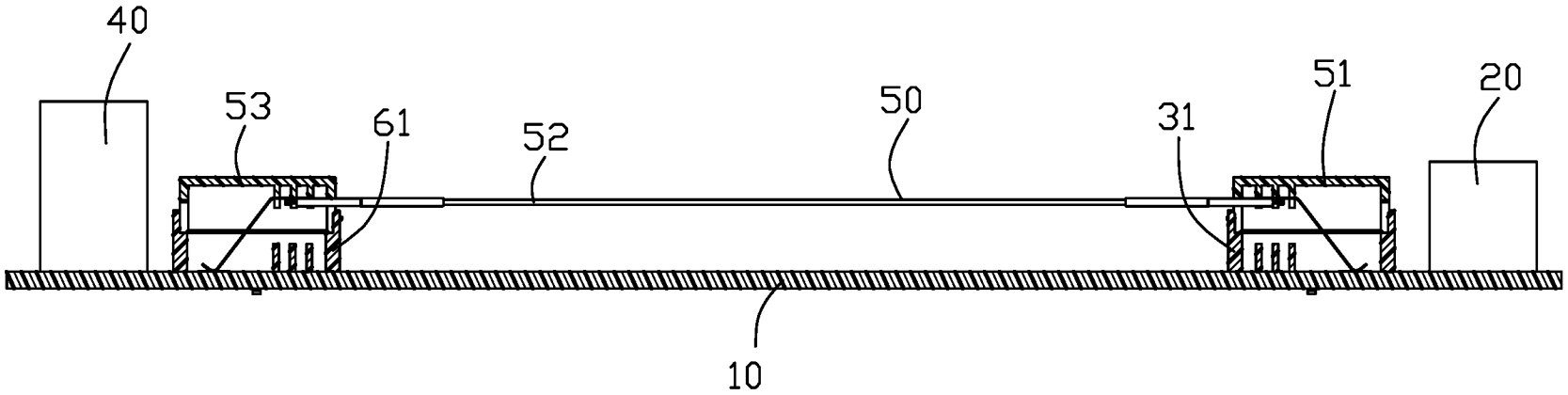
FIG. 8 is a cross-sectional view of the electrical connector system in the first embodiment as shown in FIG. 1.
Figure 9:
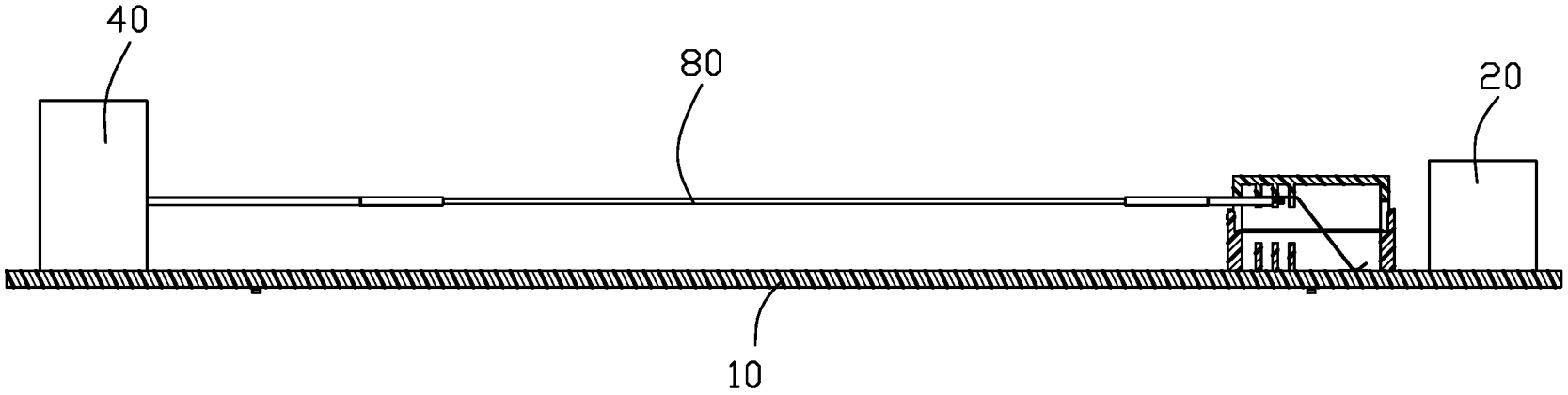
FIG. 9 is a cross-sectional view of the electrical connector system in the second embodiment as shown in FIG. 1.
Figure 10:
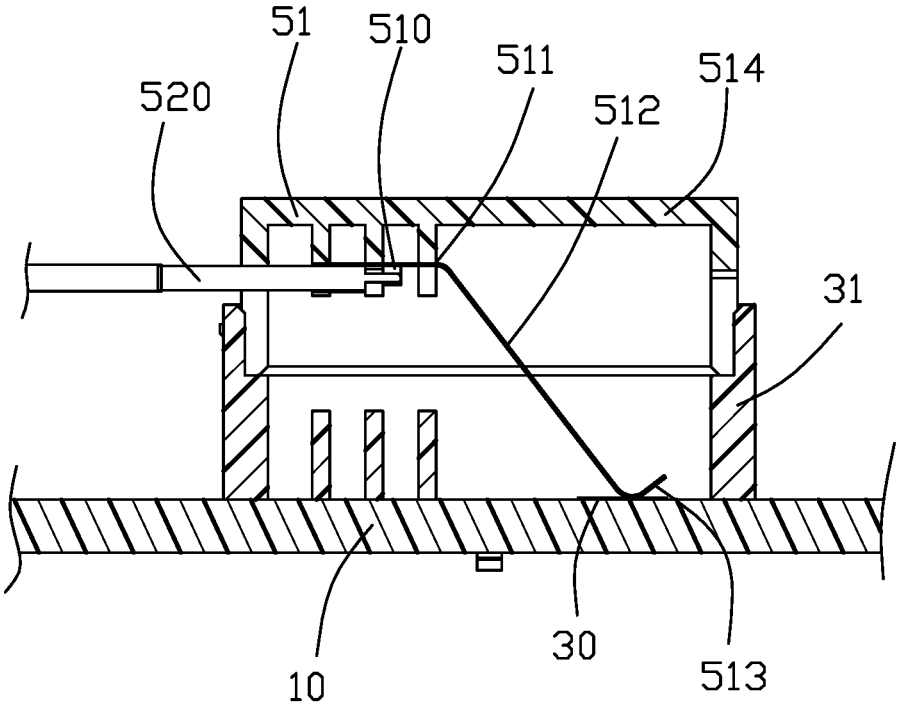
FIG. 10 is a partially enlarged view of the circled portion as shown in FIG. 1.

Referring to FIGS. 1-10, an electrical connector system 100 of the present invention includes an internal printed circuit board 10 disposed inside the electronic device, a chip 20 mounted on internal printed circuit board 10, inner conductive pads 30 disposed adjacent to the chip 20 and electrically connected to the chip 20, an interface connector 40 disposed away from the chip 20 and electrically connected to an external electrical connector and an electrical connector assembly 50 disposed inside the electronic device and electrically connected the inner conductive pads 30 and the interface connector 40. The electrical connector system supports a transmission speed of 25 Gbps or more per channel, thereby, the path of the high speed signal through the internal circuit board 10 is minimized and avoids transmission losses in internal circuit boards 10 that are difficult to upgrade or upgrade at higher cost.

The electrical connector assembly 50 includes a first connector 51 electrically connected to the inner conductive pads 30 and a cable 52 connected at one end to the first connector 51. The cable 52 can be electrically connected to the interface connector 40. The first connector 51 includes first elastic terminals 510 that resiliently abuts the inner conductive pads 30. The first elastic terminals 510 are arranged in a row in the lateral direction. The first elastic terminals 510 include a first connecting portion 511 with a cable connector, a first connecting portion 512 extending obliquely downward from the first connecting portion 511 and a first contact portion 513 that is in contact with the inner conductive pads 30 and extends from the end of the first connecting portion 512. The cable 52 has a flat structure. The cable 52 includes a plurality of cores or wires 520 arranged in a row. The first elastic terminals 510 can be riveted or otherwise mechanically and electrically connected to the corresponding cores 520. The inner printed circuit board 10 is provided with an inner frame 31 disposed outside the inner conductive pads 30. The first connector 51 includes an inner holding member or holder 514 mating with the inner frame 31 to maintain the first elastic terminals 510 elastically against the inner conductive pads 30. The inner side of the inner holding member 514 is provided with a receiving groove 515 mating with the corresponding first elastic terminals 510. The height of the first connector 51 after being mounted on the internal printed circuit board 10 is less than or equal to the height of the chip 20. Therefore, it is not necessary to avoid the interior, such as the heat sink for the chip 20, and the chip 20 can be designed closer to further reducing the transmission distance of the high speed signal on the internal printed circuit board 10.

Referring to FIGS. 1-8 and 10, the electrical connector assembly 50 further includes a second connector 53 coupled to the other end of the cable 52. An edge conductive pads 60 disposed on the internal printed circuit board 10 are disposed adjacent to the interface connector 40 and electrically connected to the interface connector 40. The second connector 53 is electrically connected to the interface connector 40 by the edge conductive pads 60. The second connector 53 includes second elastic terminals 530 resiliently against the edge conductive pads 60. The second elastic terminals 530 are arranged in a row in the lateral direction and include a second soldering portion 531 connecting with the cable connector, a second connecting portion 532 extending obliquely downward from the second soldering portion 531, and a second contact portion 533 extending from the end of the second connecting portion 532 and contacting the edge conductive pads 60. The second elastic terminals 530 can be riveted or otherwise mechanically and electrically connected to the corresponding cores 520. The internal printed circuit board 10 is provided with an edge frame 61 surrounding the edge conductive pads 60. The second connector 53 includes an edge holder 534 mating with the edge frame 61 to retain the second elastic terminals 530 resiliently against the edge conductive pads 60. The inner side of the edge holder 534 is provided with a receiving groove 535 cooperates with the corresponding second elastic terminals 530.

Referring to FIGS. 1-8 and 10, the other end of an electrical connector system 80 in another embodiment directly mechanically and electrically connected to the interface connector 40. Thereby, the transmission distance of the high speed signal on the internal printed circuit board 10 is further shortened.

The electrical connector assembly 50 of the electrical connector system 100 of the present invention is electrically connected to the internal printed circuit board 10 by elastic abutment, thereby making the overall structure simple, convenient to connect, and small in size. In brief, the invention provides a connection system between two spaced pad areas on the main printed circuit board with a cable equipped with two connectors at two opposite ends wherein each connector includes resilient contacts mechanically and electrically connecting to the corresponding pads, respectively, in a detachable manner. Notably, the connector is essentially of a stationary and locked arrangement without necessity of frequent connecting/disconnecting. Therefore, the resilient latch 519, 539 of the first connector 51 and the second connector 53 are constantly retained in the corresponding locking holes 317, 617 of the inner frame 31 and the edge frame 61, respectively, without less possibility of withdrawal therefrom. Understandably, under rare situations, via assistance of a tool to deflect the resilient latch 519, 539, the resilient latch 519, 539 can be disengaged from the corresponding locking holes, 317, 617 so as to detach the first connector 51 and the second connector 53 from the corresponding inner frame 31 and the edge frame 61, respectively, for repairing consideration. In this embodiment, the inner frame 31 and the edge frame 61 have the corresponding deflectable board locks 319 619 to lock into the corresponding through holes 109 in the printed circuit board 10 in a detachable or immovable manner. In an alternate embodiment, the inner frame 31 and the edge frame 61 may be eliminated so as to have the corresponding deflectable board lock directly formed on the first connector 51 and the second connector 53. In other words, the first connector and the second connector may be directly detachably attached upon the printed circuit board to have the corresponding resilient contacts electrically and mechanically connected to the corresponding pads, respectively, in a detachable manner, thus simplifying the corresponding structures. Therefore, the inner frame 31 may be deemed as a part of the first connector (unit) 51, and the edge frame 61 may be deemed as a part of the second connector (unit) 53 from a technical viewpoint, which may be eliminated, if the first connector 51 and the second connector 53 are modified with the increased height to compensate the height of the omitted inner/edge frame 31, 61 and with the corresponding board locks for locking to the printed circuit board while removing the resilient latches therefrom.

What is claimed is:

1. An electrical connector assembly used in an interior of an electronic device, the electronic device including an internal printed circuit board, a chip mounted on the internal printed circuit board, internal conductive pads disposed close to the chip and electrically connected to the chip, and an interface connector away from the chip and electrically connected to an external electrical connector, the electrical connector assembly comprising:

a first connector electrically connected to the internal conductive pads; and a cable connecting with the first connector, the cable being able to electrically connect to the interface connector, wherein the first connector includes first elastic terminals mechanically and electrically connected to the cable; and the first connector includes an inner holder mated with the first elastic terminals and engageable with an inner frame provided on the internal printed circuit board surrounding the internal conductive pads to retain the first elastic terminals elastically against the internal conductive pads.

2. The electrical connector assembly as claimed in claim 1, further including a second connector electrically connected to the interface connector, the cable is connected to the second connector.

3. The electrical connector assembly as claimed in claim 2, wherein the internal printed circuit board includes edge conductive pads disposed adjacent to the interface connector and electrically connected to the interface connector, and the second connector includes second elastic terminals resiliently abutting against the edge conductive pads.

4. The electrical connector assembly as claimed in claim 3, wherein the internal printed circuit board is provided with an edge frame surrounding the edge conductive pads, the second connector includes an edge holder engageable with the edge frame to retain the second elastic terminals resiliently against the edge conductive pads.

5. The electrical connector assembly as claimed in claim 4, wherein the second elastic terminals are arranged in a row, the inner side of the edge holder is provided with a receiving groove matched with the corresponding second elastic terminals.

6. The electrical connector assembly as claimed in claim 1, wherein the cable is directly electrically and mechanically connected to the interface connector.

7. The electrical connector assembly as claimed in claim 1, wherein the first elastic terminals are arranged in a row, and an inner side of the inner holder is provided with a receiving groove matched with the corresponding first elastic terminals.

8. An electrical connector system comprising:

an internal printed circuit board inside an electronic device;

a chip mounted on the internal printed circuit board;

internal conductive pads disposed close to the chip and electrically connected to the chip;

an interface connector away from the chip and electrically connected to an external electrical connector; and an electrical connector assembly electrically connecting with the internal conductive pads and the interface connector, the electrical connector assembly including a first connector electrically connecting to the internal conductive pads and a cable connecting with the first connector, the cable being able to electrically connect to the interface connector, wherein the first connector includes first elastic terminals mechanically and electrically connected to the cable;

the internal printed circuit board is provided with an inner frame surrounding the internal conductive pads; and the first connector includes an inner holder mated with the first elastic terminals and engageable with the inner frame to retain the first elastic terminals elastically against the internal conductive pads.

9. The electrical connector system as claimed in claim 8, wherein the height of the first connector after being mounted on the internal printed circuit board is less than or equal to the height of the chip.

10. An electrical connection assembly comprising:

a printed circuit board forming two spaced pad areas each having a plurality of pads thereon; and a cable including a plurality of wires with first and second connector units respectively secured to two opposite ends thereof; wherein each of said first connector unit and said second connector unit is removably attached to the printed circuit board in alignment with the two pad areas in a vertical direction, respectively, and includes a plurality of resilient contacts mechanically and electrically connected to the corresponding wires and downwardly, along said vertical direction, abutting against the corresponding pads, respectively, in an upwardly deflected manner;

each of said first connector unit and said second connector unit includes a frame attached upon the printed circuit board and a holder detachably attached upon the frame; and the holder forms a plurality of receiving grooves to retain corresponding wires and contacts therein.

11. The electrical connection assembly as claimed in claim 10, wherein each of said first connector unit and said second connector unit has at least one board lock for attachment to the printed circuit board.

12. The electrical connection assembly as claimed in claim 11, wherein the board lock extends through a corresponding though hole in the printed circuit board, and said through hole is located adjacent to the pad area.

13. The electrical connection assembly as claimed in claim 10, wherein in each of said first connector unit and said second connector unit, one of said holder and said frame forms at least a resilient latch and the other form at least a locking hole to receive said resilient latch.

14. The electrical connection assembly as claimed in claim 13, wherein said resilient latch is constantly retained in the locking hole and is unable to be disengaged therefrom unless using a tool instead of a hand.

15. The electrical connection assembly as claimed in claim 10, wherein one of said two pad areas is closer to a chip while the other of said two pad areas is closer to an interface connector.

16. The electrical connection assembly as claimed in claim 15, wherein said chip and said interface connector are located by two sides of the opposite ends of the cable in an extension direction of said cable perpendicular to said vertical direction.

* * * * *